US006520172B2

(12) United States Patent
Perrone

(10) Patent No.: US 6,520,172 B2
(45) **Date of Patent: *Feb. 18, 2003**

(54) ELECTRICALLY OPERATED PAINTBALL GUN

(75) Inventor: Aldo Perrone, Brampton (CA)

(73) Assignee: Zap Paintball Inc., Windsor (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/850,621

(22) Filed: May 7, 2001

(65) Prior Publication Data

US 2002/0088449 A1 Jul. 11, 2002

Related U.S. Application Data

(63) Continuation-in-part of application No. 09/753,818, filed on Jan. 3, 2001.

(30) Foreign Application Priority Data

Nov. 20, 2000 (CA) ..... 2326464

(51) Int. Cl.[7] ..... F41B 11/00
(52) U.S. Cl. ..... 124/74
(58) Field of Search ..... 124/77, 73

(56) References Cited

U.S. PATENT DOCUMENTS

| | | | |
|---|---|---|---|
| 4,215,867 | A | 8/1980 | Natwick |
| 4,362,145 | A | 12/1982 | Stelcher |
| 4,770,153 | A | 9/1988 | Edelman |
| 4,811,955 | A | 3/1989 | De Bernardini |
| 5,413,083 | A | 5/1995 | Jones |
| 5,881,707 | A | 3/1999 | Gardner, Jr. |
| 6,035,843 | A | 3/2000 | Smith et al. |
| 6,138,656 | A | 10/2000 | Rice et al. |
| 6,142,137 | A | 11/2000 | MacLaughlin |

FOREIGN PATENT DOCUMENTS

| | | |
|---|---|---|
| CA | 2295135 | 1/1999 |

*Primary Examiner*—Charles T. Jordan
*Assistant Examiner*—Jordan Lofdahl
(74) *Attorney, Agent, or Firm*—Barry R. Lipsitz

(57) ABSTRACT

An electrically operated paintball gun operable to shoot paintballs including a barrel, a trigger, and a breech connected to a rear end of the barrel, as well as a bolt movable in the breech between a rearward position and a forward shooting position. A spring biases the bolt towards the rearward position. A pneumatic circuit is provided to drive the bolt towards the forward position and includes a control valve in the form of a solenoid valve to receive gas under pressure and direct it into a chamber at the rear of the bolt when the gun is shot. An electronic circuit controls the pneumatic circuit and is operated by an electrical switch operated by the trigger. A gas valve mechanism is opened by engagement by the bolt, when the latter is driven forwardly to the shooting position, to permit the passage of relatively high pressure propellant gas into the barrel to propel a paintball. The spring is preferably mounted in a longitudinal passage in the bolt and is held at its front end by a fixed spring engaging member located in the passage.

15 Claims, 7 Drawing Sheets

ELECTRICALLY OPERATED PAINTBALL GUN

This application is a continuation-in-part of U.S. application Ser. No. 09/753,818 filed Jan. 3, 2001.

BACKGROUND OF THE INVENTION

This invention relates to guns capable of firing paintballs by using pressurized gas and in particular to such guns that are electronically operated.

Guns capable of firing paintballs by use of pressurized gas have been known for a number of years and they are commonly used for recreational sports such as survival or "war" games. The paintballs fired by these guns generally comprise a gelatin shell with a colored liquid or viscous substance in the interior. These paintballs are designed to burst upon impact with a target and thereby create a very visible mark on the target.

Up until recently the firing mechanisms in paintball guns have generally been mechanical in nature and have not been electrically operated. An example of such a gun is that disclosed in and illustrated in U.S. Pat. No. 5,349,939 issued Sep. 27, 1994 to Brass Eagle Inc. This gun has a hammer mechanism slidably mounted in the breech. A spring is used to drive the hammer forwards when the gun is fired. The firing mechanism requires the use of a sear device mounted on a sear pin and located in the breech area, a rear detent slidably mounted in the sear device and a spring to bias this detent so that it is engageable with the trigger.

Recently, electronically operated paintball guns have come into use and have become popular. One such paintball gun is described in recent U.S. Pat. No. 5,881,707 issued Mar. 16, 1999 to Smart Parts, Inc. The grip of the gun has an electrical switch capable of activating a launching sequence. An electrical control unit is housed within the body of the gun and a grip and can direct pressurized gas flow between the pneumatic components of the gun in order to load, cock and fire the gun. The electrical control unit includes an electrical power source which activates an electrical timing circuit when the electrical switch is closed, and two electrically operated pneumatic flow distribution devices. Upon closure of the switch, the control unit causes a projectile to be loaded into the launching mechanism by actuation of the first pneumatic flow distribution device. A paintball is fired when the timing circuit actuates the second flow distribution device to release gas from a storage chamber into the launching mechanism.

Another electronically activated gun is that described in U.S. Pat. No. 6,003,504 issued to NPF Limited on Dec. 21, 1999. This gun employs first and second gas pressure regulators with the first capable of providing high gas pressure in a first chamber of the gun. The second regulator is connected between this first chamber and a second chamber and maintains a lower working pressure in the second chamber. A control valve receives gas under pressure from the second chamber and directs it selectively to a ram slidably mounted in a cylinder. The ram is moved by gas pressure between a retracted position and a forward position where it opens a valve to allow high pressure gas to flow from the first chamber to the barrel to fire a paintball. The gun's trigger operates a microswitch which is part of an electronic control circuit for the gun.

It is an object of the present invention to provide a relatively simple, low cost, electronically operated paintball gun that employs a pneumatic circuit for driving the bolt towards a front shooting position and a spring to bias the bolt to a rearward position after the gun is shot.

It is a further object of the invention to provide a novel paintball gun that employs an electronic circuit for controlling a pneumatic circuit of the gun and that can be manufactured easily and at reasonable cost.

SUMMARY OF THE INVENTION

According to one aspect of the present invention, a paintball gun operable to shoot paintballs includes a barrel, a gun body section including a breech connected to a rear end of the barrel and a handle section, and a trigger movably mounted on said gun body section. A bolt is contained in a single elongate bolt chamber formed in the breech. The bolt is movable between a retracted position where a paintball can enter the bolt chamber through an inlet and a front shooting position where the inlet is closed. The bolt has an elongate, longitudinally extending passage formed therein. A spring is mounted in the longitudinally extending passage of the bolt. Also, a spring engaging member is mounted in this passage and is fixedly connected to the breech section. The spring is engaged by the spring engaging member at a front end of the spring and therefore is able to bias the bolt towards the retracted position. A pneumatic circuit is used to drive the bolt forwardly towards the front shooting position using pressurized gas and includes a control valve arranged to receive gas under pressure and direct the pressurized gas (when the gun is shot) into the bolt chamber to a rear side of the bolt. An electronic circuit controls the pneumatic circuit and includes an electrical switch operated by movement of the trigger. The gun further includes a gas valve mechanism mounted therein and adapted to be opened by engagement of the gas valve mechanism by the bolt in the front firing position to permit passage of pressurized gas from a pressurized gas source to the barrel to propel a paintball along and out of the barrel.

The preferred gun includes a battery connected to the electronic circuit which includes an on/off switch. The preferred electronic circuit includes a mircocomputer with a timer capable of controlling the length of time when the control valve directs gas under pressure to the rear of the hammer.

According to another aspect of the invention, there is provided in a gas powered gun for firing balls, a barrel, a gun body section including a breech behind the barrel for receiving one ball at a time through a ball feed port, a trigger movably mounted in the gun body section, and a bolt slidable within the breech to advance a ball to a shooting position and close off the feed port. This gun also has a regulator for supplying pressurized gas at a relatively low gas pressure, this regulator being adapted for connection to a source of relatively high-pressure gas. The improvement in this gun includes means for moving the bolt to a retracted position after the gun is shot. A solenoid valve having an inlet connected to the regulator is arranged to deliver relatively low pressure gas to a rear side of the bolt for moving the bolt forwardly to the shooting position when the solenoid valve is in an open position. The improvement further includes an electronic circuit for controlling the solenoid valve, this circuit including an electrical switch operated by the trigger, and a valve mechanism for permitting the relatively high pressure gas to flow into the barrel in order to propel a ball along and out of the barrel, this valve mechanism being moved to an open position by engagement of the bolt with the valve mechanism in the front shooting position of the bolt. The valve mechanism includes a movable operating member adapted to project into a bolt chamber formed in the breech until the gun is shot. The movable operating member is moved by the bolt when the bolt is driven to the shooting position and thereby opens the valve mechanism to release the relatively high pressure gas.

In a preferred embodiment, the moving mechanism is a coil spring mounted in the bolt and engaging the bolt at one end of the spring. The preferred electronic circuit is powered by a battery connected thereto and this circuit further includes a manual ON/OFF switch, and an electronic switch which is capable of shutting down the electronic circuit automatically in order to save battery power.

According to still another aspect of the invention, a gun operable to shoot balls comprises a barrel, and a gun body section attached to the barrel and including a breech section co-axial with the barrel and a movable trigger. The gun further includes a bolt mounted in the breech section and movable between a retracted position for ball loading and a forward position for shooting a ball. The gun also has means for moving of the bolt to the retracted position after the gun is shot and a first pneumatic circuit for delivering propellant gas from a supply to the barrel for propelling the ball therefrom. This first pneumatic circuit includes a first gas valve. There is also a second pneumatic circuit connected to receive pressurized gas from the gas supply, this circuit including a second valve for delivering pressurized gas to a rear end of the bolt for a short time interval in order to drive the bolt from the retracted position to the forward position and thereby cause the bolt to engage the first gas valve mechanism to open it and release the propellant gas into the barrel. An electronic circuit is also provided to operate the second valve and this circuit is operable by the trigger.

Preferably the moving mechanism of this gun is a coil spring mounted inside the bolt in a passage formed in the bolt and engaging the bolt at a rear end of the coil spring.

According to still another aspect of the invention, a gun operable to shoot balls comprises a barrel; a gun body section attached to a rear end of the barrel and including a breech section coaxial with the barrel; a movable trigger mounted on the gun body section; and a bolt mounted in the breech section and movable between a retracted position for ball loading through an inlet in the breech section and a forward position for shooting a ball. The bolt has an elongate passage formed therein. The gun also includes a spring mounted in the bolt for moving the bolt between the retracted position and its forward position. A spring holder is mounted in the elongate passage and is fixedly connected to the breech section. The spring holder engages a front end of the spring. A pneumatic circuit is also provided for delivering propellant gas from a gas supply to the barrel for propelling a ball therefrom. This pneumatic circuit includes a gas valve mechanism. When the bolt is moved from its retracted position to its forward position, the bolt engages the gas valve mechanism and causes the gas valve mechanism to open and release the propellant gas into the barrel.

Further features and advantages of the paintball gun of this invention will become apparent for the following detailed description taken in conjunction with the accompanying drawings which illustrate a preferred embodiment.

DETAILED DESCRIPTION OF PREFERRED EMBODIMENT

Figure 1:
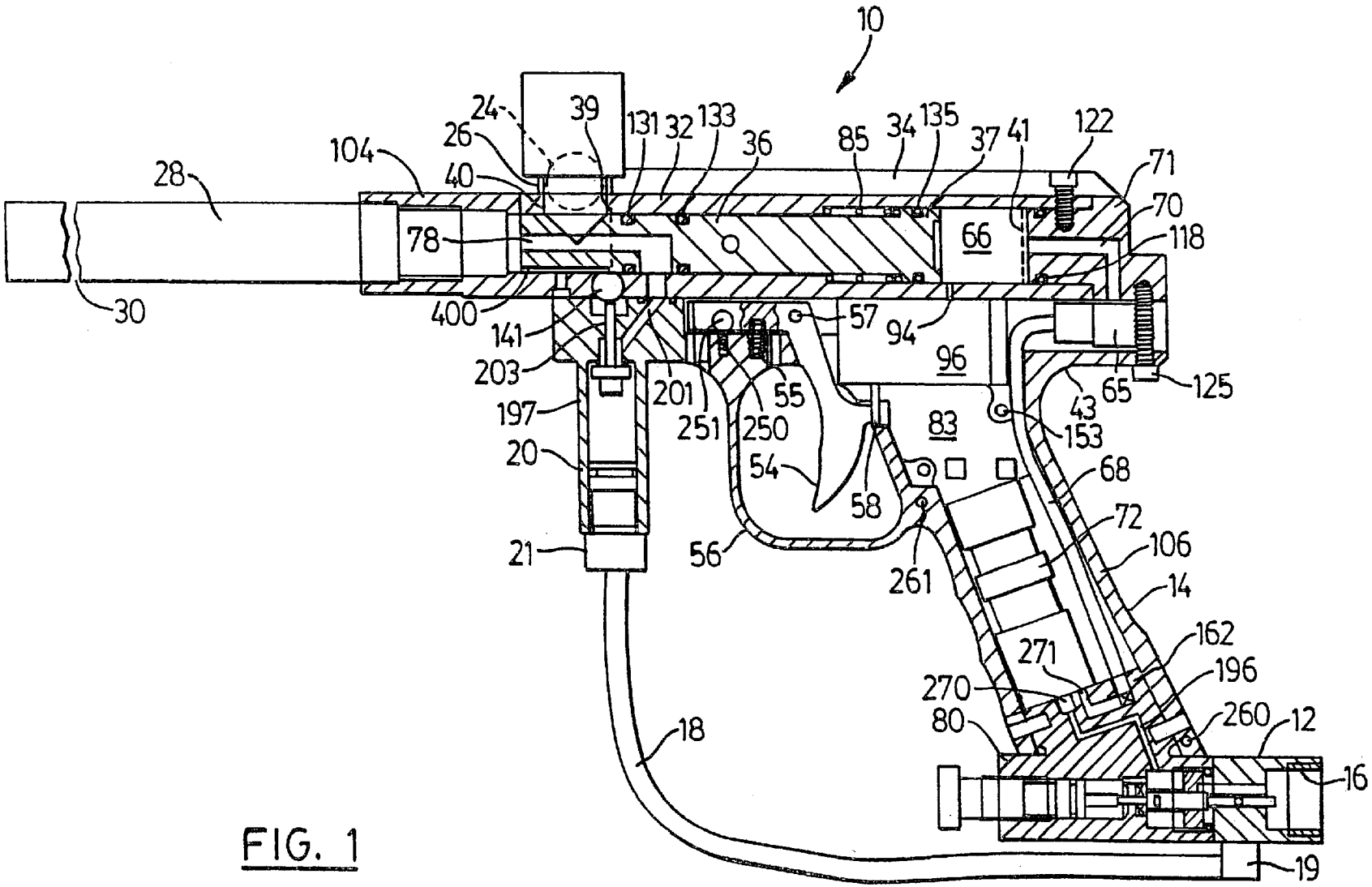
FIG. 1 is a side elevation, substantial portions of which are in cross-section, illustrating a paintball gun constructed in accordance with the invention.

A first embodiment of a paintball gun 10 constructed in accordance with the invention is shown in FIG. 1. It will be understood that this gun employs a standard $CO_2$ cylinder (not shown) which is attached by means of a standard connector housing 12 which can be connected to a bottom end of a gun grip 14. The housing 12 can be internally threaded at one end 16 where the $CO_2$ cylinder can be attached by the threads. Attached to one side of the housing 12 is a short length of flexible metal $CO_2$ hose 18 capable of carrying relatively high pressure gas, typically in the range of 750 psi and normally at least 600 psi. A standard hose fitting 19, 21 can be used at each end of the hose 18 to connect same to the housing 12 and to a downwardly extending gun firing $CO_2$ valve 20 adapted to control the flow of the relatively high pressure gas.

The gun 10 is adapted to fire paint pellets or paintballs 24, one of which is shown in FIG. 1 in a paintball feed tube 26. These paintballs are of well known construction and of standard size and they will readily break upon impact with a target. The gun 10 includes a barrel 28 which can vary in length and, as illustrated in FIG. 1, a portion of the barrel has been cut away at 30. Rigidly connected to the rear end of the barrel is a breech or breech section 32. The illustrated gun has longitudinally extending V-shaped a sight 34 on top of the breech. Slidably mounted inside of the breech is an elongate bolt 36 which can be generally cylindrical but which has a rear end section 37 of increased diameter. The bolt is movable between a retracted position indicated in dash lines at 39 (front end of bolt) and at 41 (rear end) where a paintball 24 can enter the breech 32 through an inlet 40 formed in the top of the breech and a front firing or shooting position shown in sold lines in FIG. 1 where the inlet is closed.

The breech or breech section is part of a gun body section indicated generally at 43. As explained further hereinafter the main components of this gun body section include an upper body section 104 illustrated in FIGS. 2 and 3 and a lower section 106 of the body illustrated in FIGS. 4 to 6, both of these components being described in further detail hereinafter. The gun frame or gun body section can either be made of a suitable metal or a strong, rigid plastics material such as fiberglass filled nylons.

Pivotably mounted in this gun frame is a pivotable trigger 54 which can be protected by trigger guard 56. Rearward movement of the trigger operates a standard microswitch 58, the casing of which is rigidly mounted in the gun frame. In a known manner, the trigger can operate a small button on the front of the microswitch, the pressing of this button causing the electronic circuit to which the microswitch is connected to commence a launching sequence in order to fire one or more paintballs using compressed gas. The trigger 54 can be spring biased towards its forward position in several possible ways. Firstly it can be spring biased by a spring biased button on the microswitch itself or it can be biased by a separate torsion or compression spring 55 that acts on the trigger and is mounted in the gun frame or gun body section 43. In the case of a torsion spring (not shown), it can be mounted on the trigger or pivot pin 57 for the trigger. Such springs for biasing a trigger are well known in the paintball gun art and accordingly it is deemed unnecessary to illustrate or describe in detail such a torsion spring.

A metal $CO_2$ hose connector 65 is mounted in the rear end of the gun frame. A flexible $CO_2$ hose 68 shown in FIG. 1 is connected to the connector 65 at one end and delivers pressurized gas having a relatively low gas pressure through the connector and passageway 70 in rear end plug 71 into a chamber 66 from a solenoid valve 72. The chamber 66 is formed in the upper body section of the gun and it contains a rear portion of the bolt 36. It will be understood that this pressurized gas having a relatively low gas pressure is employed in the gun in order to move the bolt rapidly forwardly towards its front shooting position where the bolt causes relatively high pressure gas to be released into the barrel through the interior of the bolt. The bolt has a high pressure gas passageway 78 in a forward section thereof and the front of this passageway opens into the barrel when the bolt has been advanced to its forward position. The bolt engages a gas valve mechanism which includes the aforementioned valve 20. For this purpose, the forward sections the bolt is formed with a shallow longitudinally extending groove 400 in the bottom of the bolt. The groove has a rear end that is spaced forwardly of an O-ring seal 131 that extends around the circumference of the bolt.

There is mounted at the bottom of the handle or grip 14 of the gun a single gas regulator 80 which is of standard construction except as described differently herein. This regulator receives the relatively high pressure gas from the $CO_2$ gas supply attached at 16 and provides pressurized gas at a substantially lower pressure to the solenoid valve 72, which is controlled by the electronic circuit of the gun. The preferred regulator 80 provides this low pressure gas at its outlet at an adjustable pressure ranging between 80 and 120 psi. The solenoid valve can be a standard two way valve having an open position in which the lower pressure gas flows through the hose 68 in order to drive the bolt forwardly and a closed position that terminates the flow of this gas through the hose. The length of time in which the valve 72 remains in the open position is precisely controlled by a programmable logic circuit (PLC) or microcomputer of the gun. This circuit or the microcomputer can be constructed to fire the gun not only once but two or three or more times with a single pull of the trigger, if desired. The number of paintballs fired in a single burst can be set by the user, for example, by a setting established with small buttons or pins or a single button or pin mounted in the side of the gun (see the circuit description below).

The electronic circuit board, which includes the PLC or microcomputer can be mounted in the grip 14 and is indicated at 83 in FIG. 1. A detailed description of one version of the electronic circuit board is provided below. It will be understood that the length of time that the lower pressure gas is delivered through the passageway 70 and into the chamber 66 is dictated by the PLC or microcomputer which controls the operation of the valve 72 through which this gas flows.

Once the bolt has advanced to the front firing position, the pressurized gas to the rear of the bolt must be released from the chamber 66. This can be accomplished by a suitable air outlet passageway formed in the breech section and which can be located at 94. The outlet 94 is located in the wall of the chamber just to the rear of the bolt when the bolt is advanced to the front shooting position. The pressure created by any remaining air in the chamber is readily overcome by the force of the coil spring 85 in order to return the bolt to the retracted position. A battery, such as a 9 volt battery can be mounted at any one of several possible different locations in the body of a gun, this battery being connected to the electronic circuit board 83. A 9 volt battery mounted just to the rear of the trigger is illustrated at 96 in FIG. 1. A simple, electrical on-off switch (not shown) is also mounted on the side of the gun at a convenient location in order to turn the electrical control circuit on for use of the gun.

Instead of using the external gas hose 18, it will be appreciated by those skilled in the paintball gun art that internal gas passageways can readily be formed in the gun body including the grip 14 to allow the passage of pressurized gas between the required points. By providing internal gas passageways in the gun to replace the hose 18, one will avoid or lessen the possibility of the hose interfering with the use of the gun.

One possible construction for the low pressure gas regulator 80 is that of the low pressure regulator illustrated and described in U.S. Pat. No. 5,878,736 which issued Mar. 9, 1999. This low pressure regulator has a hollow piston, a coil spring and a seal all contained within a housing. The disclosure and drawings of this U.S. patent in connection with the low pressure regulator are incorporated herein by reference. This known regulator is capable of providing constant lower pressure gas at its outlet port in the range of 80 to 150 psi.

Mounted on the upper body section 104 is the paintball feed tube 26 which opens into the circular hole or inlet 40 in the top of the body section 104. Extending along the top of the body section 104 is an optional longitudinal ridge 34 which forms a V-shaped sight. Extending through the body section 104 is a straight, longitudinal upper passage 112 shown clearly in FIG. 2. Slidably mounted in the upper passage 112 is the bolt 36. Extending into the rear end of the passage 112 is the rear end plug 71. There is an O-ring 118 mounted in a circumferential groove formed around the rear end plug 71. This plug member is held in place by an upper screw 122 that extends through a hole 123 formed in the rear end of body section 104. The plug is also held in place by a second screw that extends through a hole 164 in the lower section 106 of the gun. There can also be two additional screws (not shown) that extend into opposite side of the plug 71 and through holes 127 (one of which is sown in FIG. 2) in the sidewalls of the upper body section 104.

In order to further seal the chamber formed at the rear of the bolt, an O-ring seal 135 extends around the circumference of the bolt near its rear end. This seal is located in a circumferential groove. The bolt 36 is also fitted with two O-ring seals 131, 133 mounted in circumferential grooves in the bolt. These two seals act to seal the section of the bolt where the propellant gas enters the passageway 78 when the gun is shot.

Figure 2:
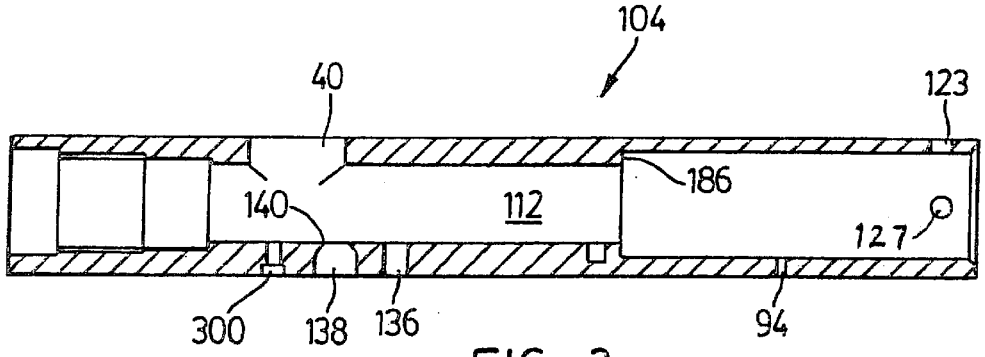
FIG. 2 is a longitudinal cross-section of the upper gun body section taken along the line II—II of FIG. 3.
Figure 3:
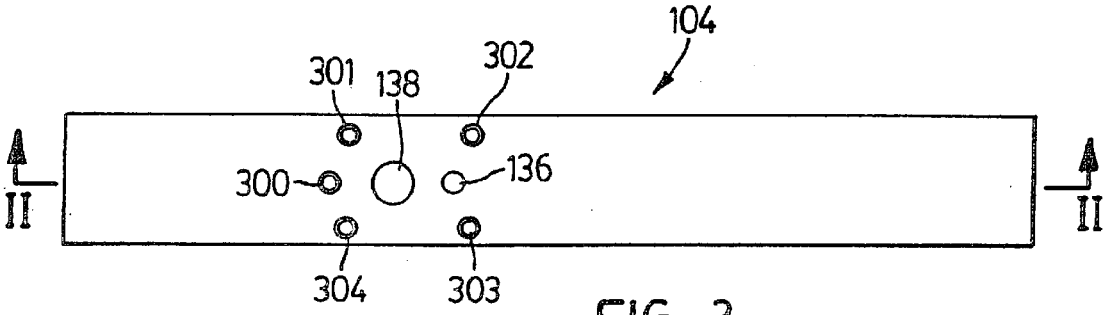
FIG. 3 is a bottom view of the upper body section of FIG. 2.

Referring now to certain details of the upper body section shown in FIGS. 2 and 3, this section is formed with a hole for the passage of high pressure gas at 136. Arranged a short distance in front of this hole is a larger hole 138 having a circumferential lip 140 extending around its upper edge. The hole 138 is sized to receive a ball bearing 141 having a diameter substantially equal to the diameter of the hole 138 below the lip. This ball bearing is movable up or down in its hole 138 and is one type of movable operating member for the gas valve mechanism that includes the gas valve 20. The ball bearing 141 normally projects into the bolt chamber formed in the breech section 32 and it is engaged and moved by the bolt when the bolt is moved to its front shooting position in order to open the gas valve mechanism and release the pressurized propellant gas. It will be understood that the ball bearing is captured in the wall of the breech section 32 and extends into the groove 400 of the bolt except when the bolt is in its front shooting position. Also formed in the bottom of the upper body section 104 are five small holes 300 to 304. The hole 300 is located directly in front of the hole 138 and is used to mount a small rubber detent (not shown) that projects in a known manner into the bolt chamber in order to hold the paintball in position until the gun is shot. The threaded screw holes 301 to 304 are distributed around the hole 138 and these receive screws (not shown) that are used to attach a housing for the gas valve 20 to the upper body section.

Figure 4:
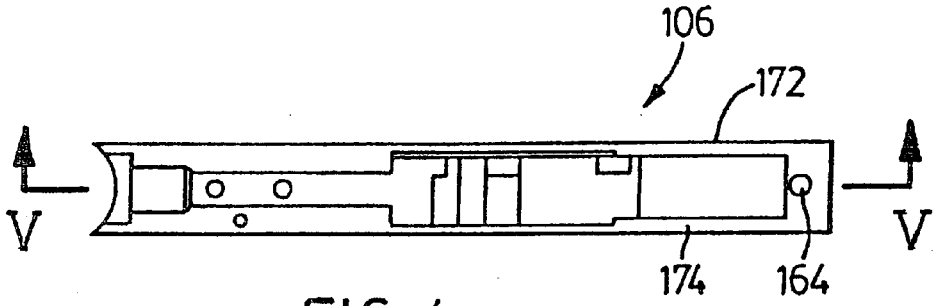
FIG. 4 is a top view of a lower section of the gun body.
Figure 5:
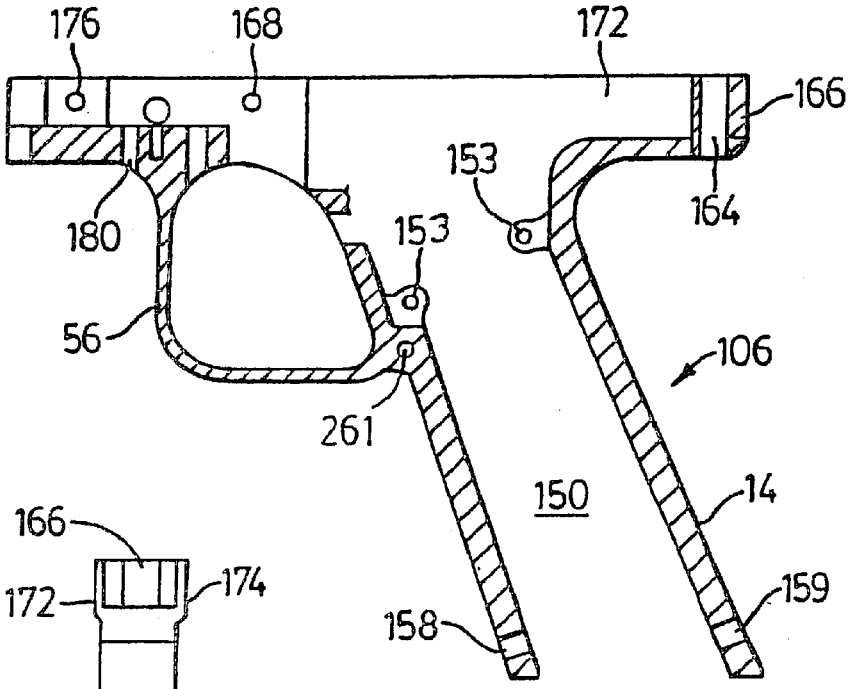
FIG. 5 is a longitudinal cross-section of the lower section, this view being taken along the line V—V of FIG. 4.
Figure 6:
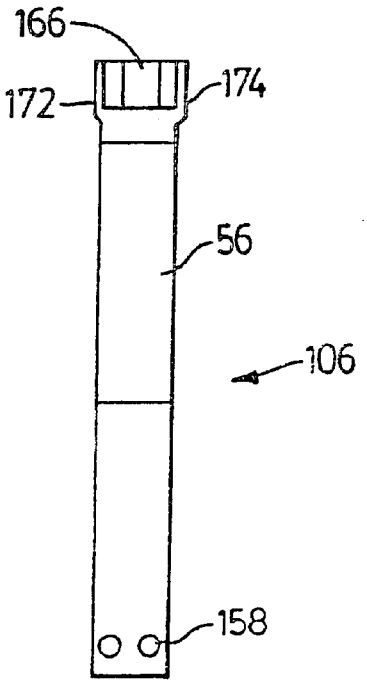
FIG. 6 is a front view of the lower body section of FIG. 5.

In one embodiment of the gun (i.e. the one illustrated by FIGS. 1 to 3), the portion of the gas valve housing at the top of valve tube 197 is formed integrally with the lower section 106 of the gun (see the section shown in FIGS. 4 to 6). Accordingly the entire lower section of the gun including the gas valve housing can be attached at the front end to the upper body section by the four screws extending into the holes 301 to 304. In the alternative, it is also possible for the portion of the gas valve at the top of tube 197 to be separate from the lower section 106 shown in FIGS. 4 to 6. In this case, both parts can be attached separately by any suitable means (including screws) to the upper body section 104.

Figure 9:
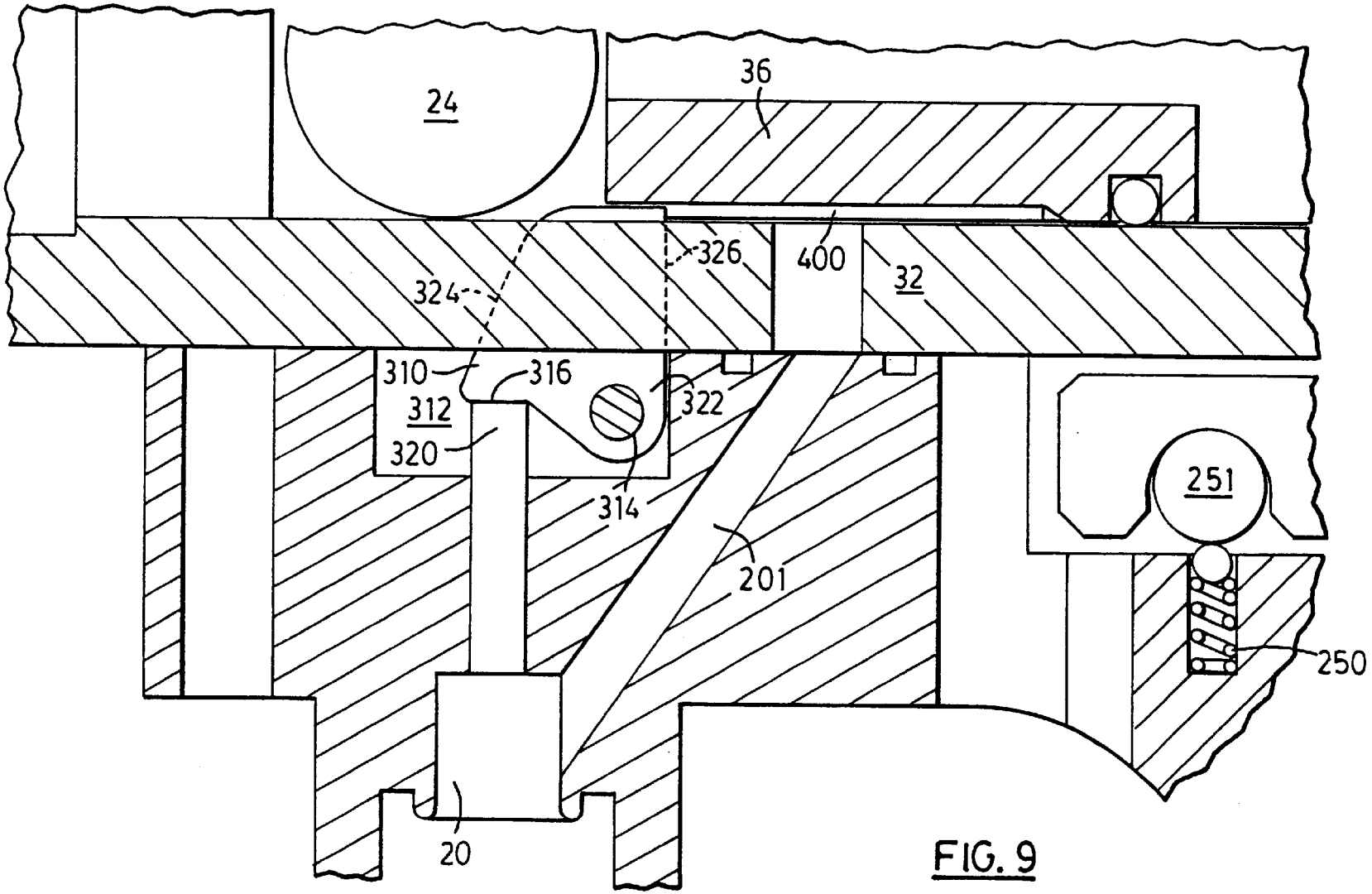
FIG. 9 is a detail view in longitudinal cross-section showing a preferred mechanism for operating a high pressure gas valve used to release propellant gas into the bolt chamber.

FIG. 9 illustrates a preferred movable operating member for the gas valve 20. This member comprises a lever member 310 that is pivotably mounted in a recess 312 and that can be attached to the gun body section by means of pivot pin 314. It will be understood that the lever member extends through a suitable opening in the bottom of the breech section and, in the retracted position of the bolt extends into the front end portion of the groove 400 of the bolt. A flat shoulder 316 is formed on the bottom of the lever member and this flat portion engages the top of a movable valve pin 320. The lever member also has a rounded bottom end section 322 through which the pivot pin 314 extends. As illustrated the lever member can also have an upwardly and rearwardly sloping front surface 324 and a rear surface at 326. It will be understood that the lever member 310 is engaged and moved by the bolt when the bolt is moved to its front shooting position in order to open the gas valve mechanism and release the pressurized propellant gas. After the propellant gas is released and the paintball has been shot, a valve spring acting on the pin 320 pushes both the pin and the lever member upwards to the position shown in FIG. 9.

Turning now to the lower body section illustrated in FIGS. 4 to 6, the lower body section forms a cavity 150 in which is mounted the solenoid valve 72 shown in FIG. 1. Projecting into the interior of this cavity are two connectors 153 that form screw holes for mounting the electronic circuit board 83 shown in FIG. 1. Two mounting screws (not shown) are used for this purpose. Formed in the bottom of the body section 106 are front and rear screw holes 158, 159. By means of three screws (not shown) extending through these holes, there is mounted at the bottom end of the cavity 150 the gas pressure regulator 80. This regulator is formed with an upwardly projecting extension 162 through which extend passageways for the low pressure gas.

Returning to the body section 106, this section has a rear end hole 164 for the passage of the aforementioned screw 125 and there is a short rear wall 166. Located above the trigger guard 56 are two small holes 168 which are used to support the trigger pin 57. The two holes 168 are formed in short upper sidewalls 172, 174 which extend from the front end of the body section to the rear wall 166. It will be understood that plastic or wooden hand grips (not shown) can be attached to both sides of the illustrated body section 106. These hand grips can be detachably connected to the frame or body section by means of two screws on each side that are threaded into screws holes 260,261.

There are means for biasing or moving the bolt so as to move the bolt 32 to its rearward or retracted position. One form of biasing means is a spring 85 mounted in the breech section. For this purpose, it will be seen from FIGS. 1 and 2 that the passageway 112 is formed with a larger internal diameter at a rear portion thereof so as to accommodate the spring. Thus, the front end of the spring bears against an internal shoulder 186 while a rear end of the spring bears against a shoulder formed near the rear end of the bolt. The spring 85 is a coil spring that extends about the circumference of a rear portion of the bolt.

Figure 8:
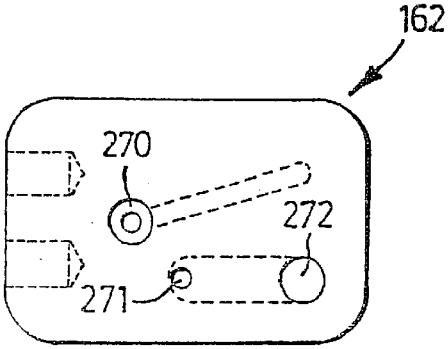
FIG. 8 is a top end view of an upward extension of a regulator used in the paintball gun.

The gun 10 of FIG. 1 includes what can be termed a pneumatic circuit for driving the bolt forwardly towards the front shooting position. This pneumatic circuit includes the aforementioned solenoid valve 72 which is arranged to receive gas under pressure from the regulator 80 and direct this gas to a rear side of the bolt when the gun is shot. In order to conduct the pressurized gas from the outlet of the solenoid valve to the passageway 70 of the plug member 71, there extends through the grip 14 the flexible hose 68. The bottom end of the hose connects to the upward extension 162 of the regulator which is formed with internal gas passages 196. It will be understood that the inlet of the solenoid valve is connected by means of one of these passageways to the outlet of the regulator. Shown in FIG. 8 is the top end of the upward extension 162. This inlet of the solenoid valve is connected to the outlet of the regulator 80 at opening 270 while the outlet of the valve is connected to a small opening 271. The bottom end of the hose 68 is connected to the outlet opening at 272.

The high pressure gas valve 20 is mounted in a downwardly extending tube 197 which can be seen in FIG. 1 and the hose 18 extends from the bottom of the tube 197 to a bottom outlet for high pressure gas located in the housing 12. As indicated, the gas valve 20 is adapted to be open by engagement by the bolt in the front shooting position to permit passage of pressurized gas from a pressurized gas source (i.e. the aforementioned $CO_2$ cylinder) to the barrel to propel the paintball. The valve 20 receives relatively high pressure gas usually having a pressure of at least 600 psi or more and this valve has an outlet passage at 201 leading to the bolt chamber of the breech section. The bolt is contained in this elongate chamber. When the bolt engages the bearing ball 141 at the top end of the valve mechanism, the valve 20 will be open for a brief period of time sufficient to shoot the paintball at an appropriate speed. The valve 20 can be considered part of a pneumatic circuit (hereinafter referred to as the first pneumatic circuit) in the gun for delivering propellant gas at a relatively high pressure to the barrel. In the illustrated valve mechanism, the metal bearing ball 141 rests on top of a valve or poppet pin 203 which will be forced downwardly to move a valve member away from a valve seat for a brief period of time, thereby opening the valve 20 and allowing propellant gas to flow through the valve.

The battery 96 is capable of powering the electronic circuit which in a preferred version will switch off automatically under predetermined conditions (such as a period of non-use) in order to save the life of the battery. It will also be understood that means (not shown) are provided for gaining access to the battery compartment in the handle, for example, a removable battery cover can be provided in the lower body section 106 on one side of the battery chamber.

In one preferred version of the gun, the solenoid valve 72 is a standard valve operable on 6 volts such as Model EV-3M 6VDC available from Clippard, a U.S. company.

Figure 7:
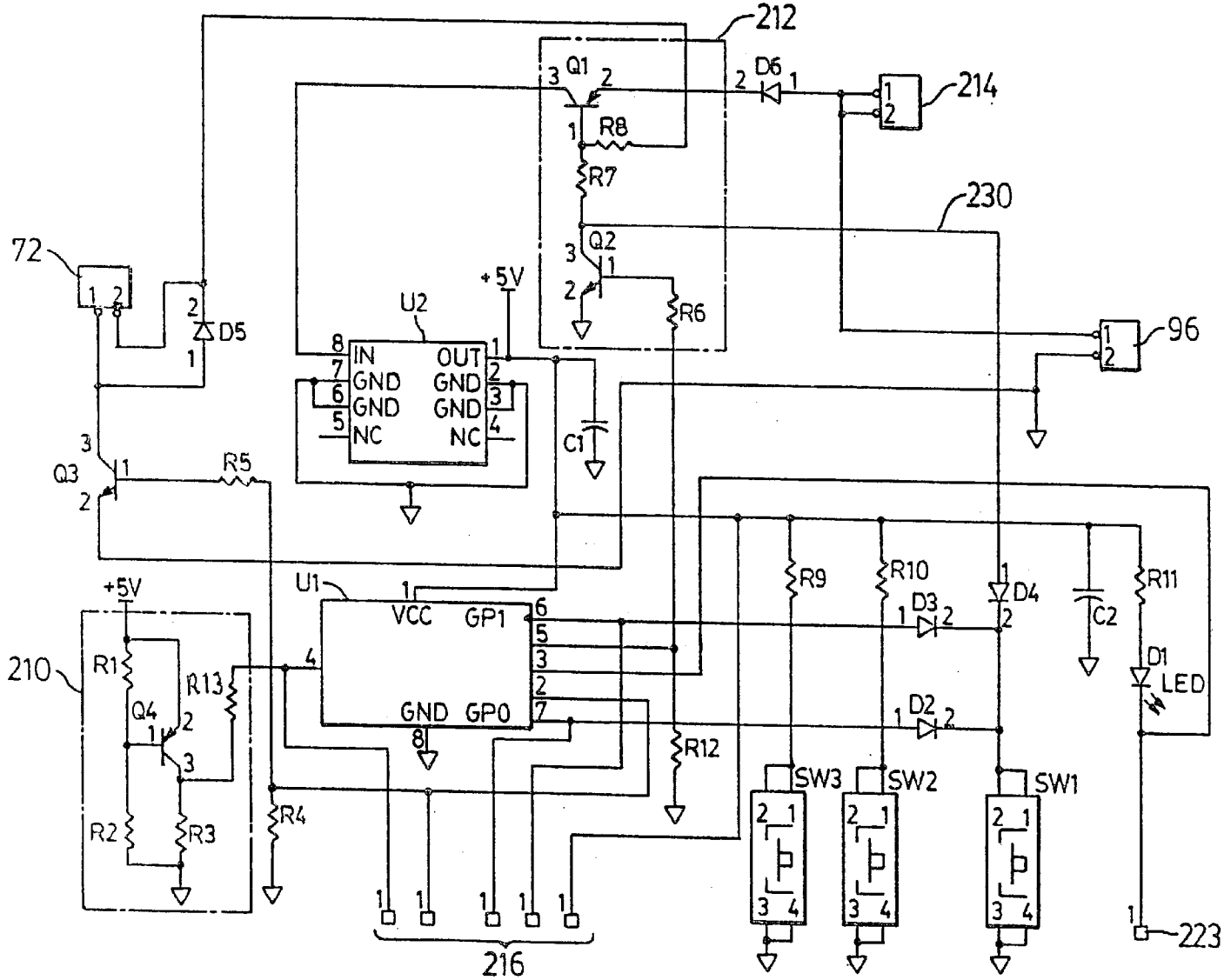
FIG. 7 is a circuit diagram for a preferred electronic circuit to operate the gun of the invention.

Reference will now be made to FIG. 7 which illustrates a preferred form of electronic circuit for controlling the pneumatic circuit which includes the aforementioned solenoid valve 72. In the illustrated circuit, the 9 volt battery 96 with its terminals is indicated on the right side and the solenoid valve 72 is indicated on the left side. The basic electronic circuit as illustrated includes two integrated circuits identified as U1 and U2 and four transistors. Preferably U1 is an eight bit microcomputer such as MCU Model PIC12C508/SO available from Microchip. This particular microcomputer has built-in internal R/C oscillation, an internal power up reset, and LED direct drive capability and is one time programmable. The voltage to the microcomputer U1 is controlled and regulated by voltage regulator U2 such as the regulator part No. UA78L05C/SO. This regulator is able to provide a positive five volt Vcc which powers capacitors $C_1$ and $C_2$ and the microcomputer. The regulator keeps the input Vcc at a relatively constant level.

The voltage level provided is monitored by a brown out circuit indicated at 210. The purpose of this circuit is to reset the microcomputer and prevent its operation when the voltage being provided is below a certain level, for example, 4 volts. Once the voltage level $V_{BF}$ is less than 0.7 volts, the transistor Q4 will be switched off from the $V_{cc}$ and the resistance of $R_4$ (which is one tenth of the internal pull up value on the master clear (MCLR) pin) will pull down the voltage level on the MCLR pin to a point that the microcomputer is put in a reset state. This brown out circuit is desirable due to the rapid On/Off of the power On/Off switch which may induce voltage fluctuation that could incorrectly reset the microcomputer U1.

Another significant aspect of the illustrated circuit is an electronic ON/OFF switch indicated at 212. The transistors Q1 and Q2 provide this electronic ON/OFF switch. Any bias current across Q1 BE junction will cause Q1 to conduct. The transistor Q2 acts as a latch to supply power to the electronic circuit once the microcomputer has been turned on and after the power ON/OFF switch is released. A suitable transistor for Q1 is MMBT 3906 while a suitable transistor for Q2 is MMBT 3904. The resistance R8 puts the transistor Q1 in reverse bias in the OFF state. The resistance R7 which is located between transistors Q1 and Q2 limits the bias current across Q1 and the collector current into Q2.

The circuit of FIG. 7 includes three mechanically operated or manually operated electrical switches SW1, SW2 and SW3. The switch SW1 is a manual power ON/OFF switch which can, for example, be located on a side of the gun handle 14. This switch permits the user of a gun to switch the circuit to the ON condition so that the gun can be operated. The switch SW2 is used for setting the firing sequence of the gun. In one preferred electronic circuit the firing sequences that are available are one shot, two shot, three shot, and five shots for each trigger pull or automatic fire. The user can select which firing sequence he wants by simply pushing the switch button or pin the number of times that he wants the gun to fire for each trigger pull. In other words, if the switch SW2 is pushed twice, the firing sequence will be two paintballs fired for each trigger pull. The selected firing sequence will be indicated by the flashing sequence of the light emitting diode (LED) D1 (i.e. two flashes on the LED indicating two shots will be fired for each pull). A fire-select routine of the program of the microcomputer causes the LED diode to flash in this manner and once the firing sequence is selected, this routine will wait until the selection key is released before it goes back to the main loop of the program. The switch SW3 is the switch operated by the trigger 54. A suitable switch for SW1 and SW2 is switch part TS-1143 while a suitable switch for SW3 is switch part TS-1131 V.

It will be understood that the transistor Q3 is a current booster that drives the solenoid valve at 152 with the diode D5 acting to protect the back EMF from the solenoid valve. The diode D6 located in a line between the battery and the electronic ON/OFF switch is a polarity protector to protect the circuit should the 9 volt battery 204 be installed in wrong polarity. The item 214 indicated in the upper right corner of the circuit near the diode D6 represents an optional additional ON/OFF switch that can be manually operated. If this optional switch is not provided, then the terminals for this switch are shorted. Also, the small square boxes shown at the bottom of FIG. 12 and indicated by reference 216 are simply test point locations used by the manufacturer of the electronic circuit.

Once the transistor Q2 is conducting, it grounds the signal path on GPO, GP1 of the microcomputer U1 to inform the computer that the electronic circuit will be switched OFF. The diodes D2 and D3 are used to avoid cross-conduction between GPO and GPI while the diode D4 is used to block current flow in the reverse direction along conduction path 230 that extends between the switch SW1 and the electronic switch 212. The resistor R13 located between Q4 and the microcomputer is used to isolate the brown out circuit for In-circuit programming, that is, programming the one time programmable circuit board.

In one preferred, programmed electronic circuit for the gun of this invention, the ON time for the solenoid valve is fixed at 15 mS and 17 mS for shots after the first, thus allowing more gas flow for repeating shots. The maximum shots per second are limited to eight shots per second in the preferred program in order to give sufficient loading time for each paintball to drop into the gun breech under natural gravitational force. It will be understood that the microcomputer includes a timer capable of controlling the length of time the solenoid control valve directs the propellant gas to the rear side of the bolt.

Set out below is a list of the resistors used in the preferred circuit of FIG. 7 along with the resistance valves in a particular preferred version of this circuit:

| RESISTORS | SIZE |
|---|---|
| R1 | 68K |
| R2 | 330K |
| R3 | 33K |
| R4 | 4K7 |
| R5 | 150 |
| R6 | 33K |

-continued

| RESISTORS | SIZE |
|---|---|
| R7 | 4K7 |
| R8 | 4K7 |
| R9 | 33K |
| R10 | 33K |
| R11 | 470 |
| R12 | 4K7 |
| R13 | 470 |

With respect to the diodes used in a preferred version of the circuit of FIG. 7, the diodes that can be used are as follows:

| DIODES | IDENTIFIED |
|---|---|
| D1 | LED |
| D2 | LL4148 |
| D3 | LL4148 |
| D4 | LL4148 |
| D5 | DL4001 |
| D6 | DL4001 |

With respect to the capacitors used in this preferred circuit, the capacitance values are as follows:

| | |
|---|---|
| C1 | 100 nF |
| C2 | 22 uF |

The microcomputer U1 is programmed in the following manner. After the power is reset, the microcomputer U1 initializes the I/O direction register. The I/O ports are set which latches the electronic ON/OFF switch 212 into the "ON" state. The RAM is cleared and the following parameters are set:

1) Set the ON time for the solenoid valve 152.
2) Set the period to fire a single shot.
3) Initialize the time interval to run the routines.
4) Initialize the default number of fires per trigger pull (default=single shot per trigger pull).
5) Turn on the LED.

The program will wait until the power ON/OFF switch is released by the user and then the program will loop around the main loop routine to check if any key has been pressed, for example, the selection switch or the trigger switch. If the trigger has been pressed, it will go to a routine to turn on the solenoid and loop around to complete the number of shots that have been selected. Then it will wait until the trigger is released before it returns to the main loop routine.

If the switch for the shot selection has been pressed, it will go to a firing routine to change the number of shots fired per trigger pull. In a preferred embodiment, the possibilities that can be selected include one shot, two shot, three shot or five shots per trigger pull, or automatic firing. Once selected, it will change the flashing sequence of the LED to indicate the new setting and wait until the selection key is released before it goes back to the main loop routine. If the program detects that both the trigger switch and the selection switch have been pressed simultaneously, it will assume that this is a power OFF signal and turn the LED OFF. The program then waits until the switch or switches are released and turns off the latch on transistor Q1 and goes into a dead loop until the power is cut.

Note that in any program loop in the main program, a timer routine will be called upon. This is a timer service routine served every 1 mS. It is the timer routine in the microcomputer which enables the microcomputer to turn the solenoid value to the ON position for the required time intervals, for example, 15 mS or 17 mS.

The gun 10 can be provided with any suitable form of known safety mechanism to prevent the gun from accidentally being fired. The illustrated gun 10 is provided with a safety mechanism, this mechanism comprising a safety spring 250 and a safety pin 251. In known manner the spring biases upwardly a small ball bearing located at the top thereof. This bearing can engage one of two small, annular grooves extending about one end section of the pin 250 in order to hold it in one of two possible positions (i.e. firing and non-firing). The horizontal pin 251 which extends in the transverse direction has a central groove or recess that, when aligned with the horizontal extension of the trigger, will allow the trigger to be pulled and the gun shot.

Figure 10:
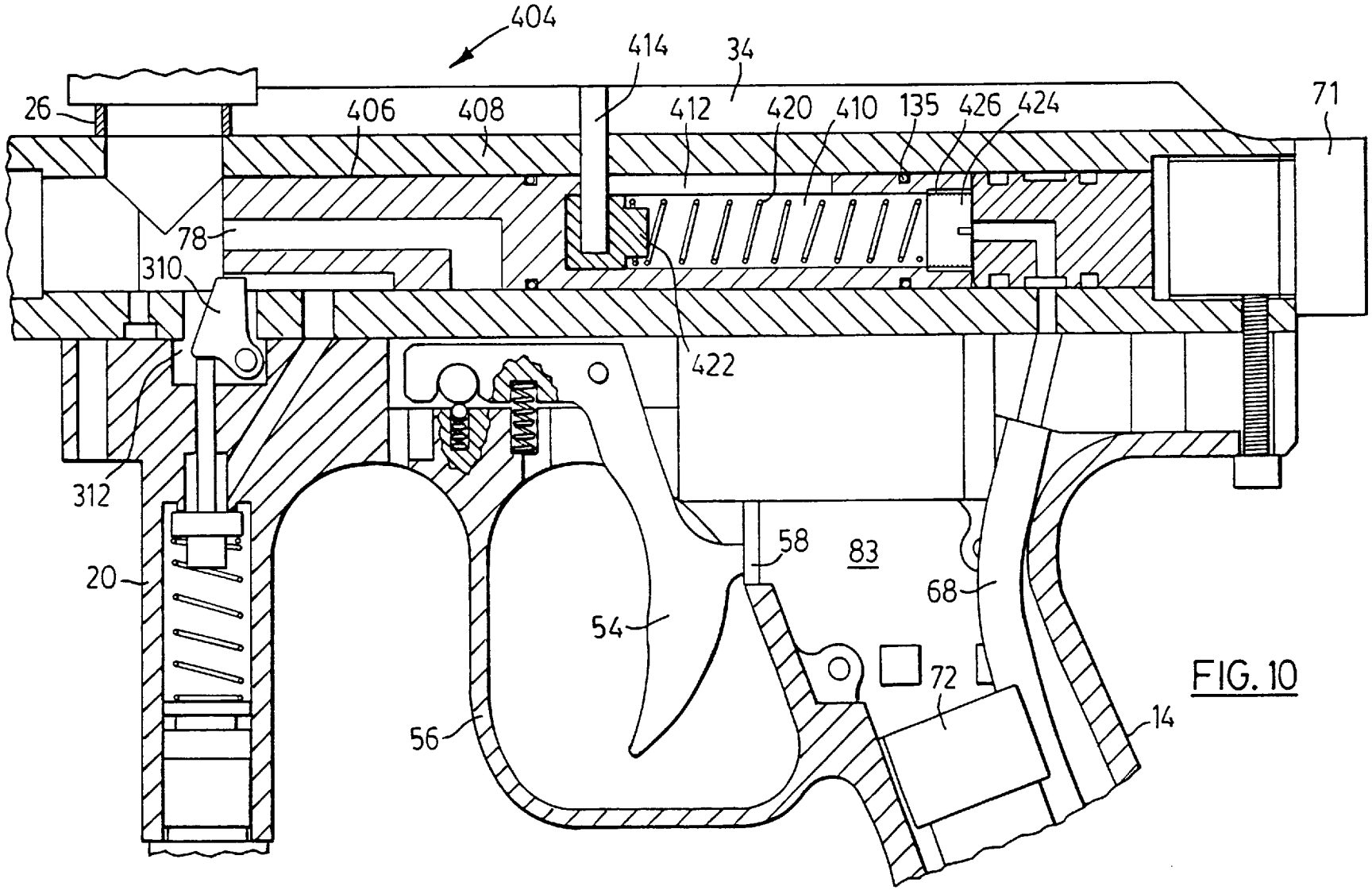
FIG. 10 is a cross-sectional elevation similar to FIG. 1 showing the breech and trigger sections of another embodiment of a paintball gun constructed in accordance with the invention, this figure showing the bolt in the retracted position.
Figure 11:
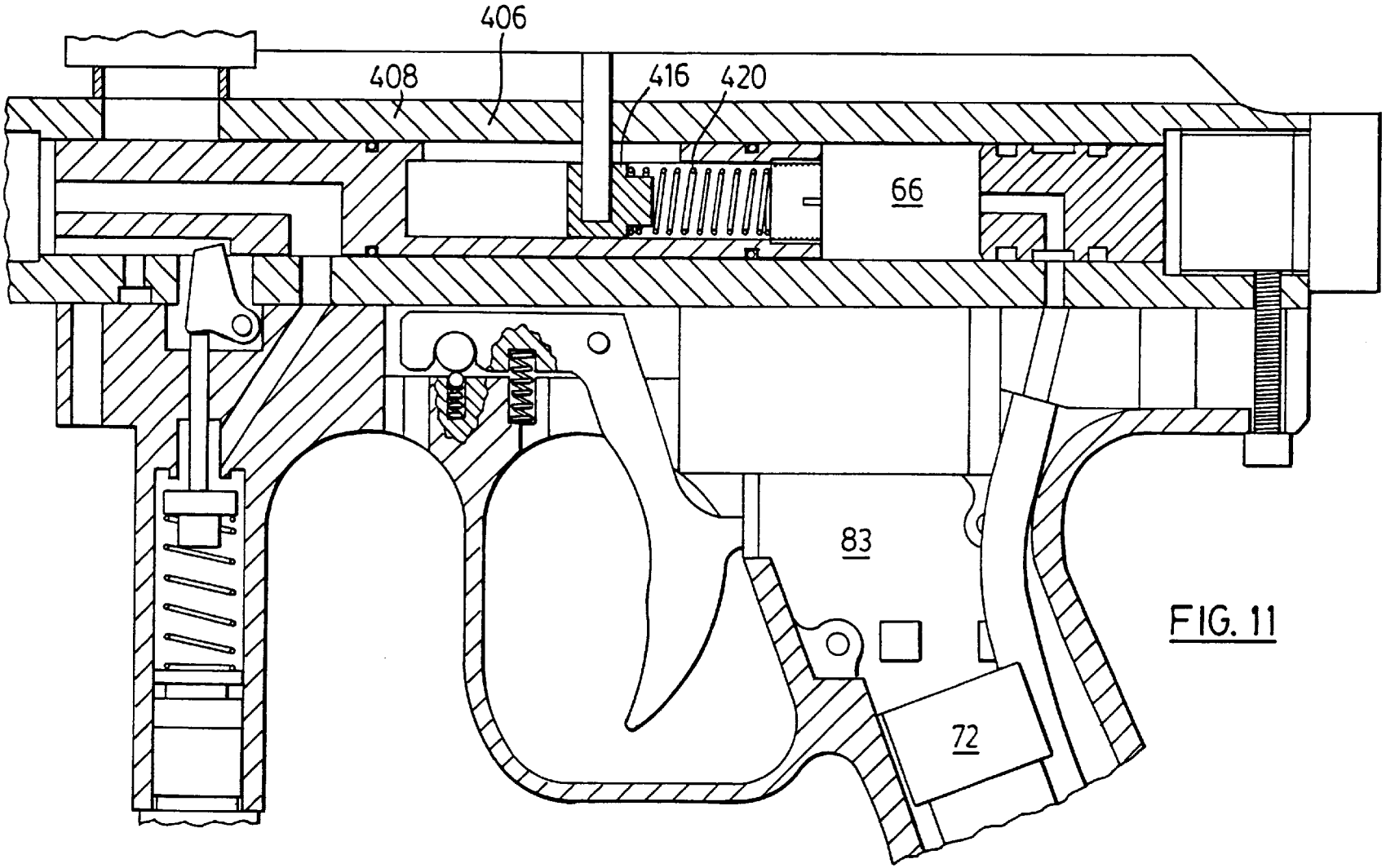
FIG. 11 is a cross-sectional elevation similar to FIG. 10 but showing the bolt in the front shooting position.

FIGS. 10 and 11 illustrate an alternate embodiment of a paintball gun constructed in accordance with this invention. This gun 404 can be constructed in substantially the same manner as the above described gun illustrated in FIGS. 1 to 9 except for the differences noted hereinafter. These differences relate to the construction of the bolt which is identified by reference 406 in FIGS. 10 and 11 and a breech 408 in which the bolt is slidably mounted.

The front portion of the bolt an be similar in its construction to the bolt 36 shown in FIG. 1. As in the bolt 36, there is a L-shaped high pressure gas passageway 78 formed in the front section of the bolt. However in the rear section of the bolt there is elongate, longitudinally extending passage 410 that extends to the rear end of the bolt. This passage can be circular in cross-section and extending between this passage and the outer circumference of the bolt is an elongate slot 412, the length of which is approximately the sane as the extent to which the bolt is slidable in the breech. Extending through the slot is a rigid connecting pin 414. Arranged in the passage 410 is a spring engaging member or spring holder 416. The pin 414 is securely fastened at its bottom end to the member 416 and the pin also is secured to the top of the breech 408 through which it extends. Thus the spring engaging member 416 is rigidly mounted in the breech while the bolt is slidable relative to the member 416.

An elongate coil spring 420 is mounted in the longitudinally extending passage 410 of the bolt and engages the bolt at a rear end of the spring. The front end of the spring is engaged by the aforementioned spring engaging member 416 and thus the spring is able to bias the bolt towards the retracted position. In the illustrated preferred embodiment, there is a cylindrical, rearward extension 422 formed on the member 416 and the front end of the spring extends about this rearward extension and is held in position thereby.

To allow for insertion of the spring into the passage 410 and for the capture of the spring therein, the bolt 406 is fitted with an externally threaded cap member 424. A rear end section of the bolt is formed with internal threads at 426 and these threads engage those on the cap member. As illustrated, the cap member is threaded completely into the bolt so that it is located in the longitudinally extending passage 410.

It will be appreciated that the spring engaging member 416 holds the front end of the coil spring so as to prevent forward movement of the coil spring beyond the member 416. Thus the bolt is effectively biased rearwardly towards the retracted position shown in FIG. 10. It will be appreciated that the spring engaging member 416 acts as a stop that prevents forward movement of the front end of the spring.

One advantage of the spring arrangement in the embodiment of FIGS. 10 and 11 is that the spring is entirely contained within the bolt and thus it is not required to rub against either the exterior surface of the bolt or the cylindrical cavity in which the bolt is slidably mounted. The arrangement of FIGS. 10 and 11 can provide a longer operating life for the coil spring.

It will be appreciated that various modifications and changes can be made to the paintball guns as described herein without departing from the spirit and scope of this invention. Accordingly, all such modifications and changes as fall within the scope of the appended claims are intended to be part of this invention.

What is claimed is:

1. A paintball gun operable to shoot paintballs, said gun comprising:

a barrel;

a gun body section including a breech section connected to a rear end of said barrel and a handle section;

a trigger movably mounted on said gun body section;

a bolt contained in a single elongate bolt chamber formed in said breech section, said bolt movable between a retracted position where a paintball can enter said bolt chamber through an inlet provided in said breech section and a front shooting position where said inlet is closed, said bolt having an elongate, longitudinally extending passage formed therein;

a spring mounted in said longitudinally extending passage of the bolt and engaging said bolt at a rear end of the spring;

a spring engaging member mounted in said longitudinally extending passage and fixedly connected to said breech section, said spring being engaged by said spring engaging member at a front end of said spring and therefore acting to bias the bolt towards said retracted position;

a pneumatic circuit for driving said bolt forwardly towards said front shooting position using pressurized gas and including a control valve arranged to receive gas under pressure and direct this pressurized gas into said bolt chamber to a rear side of said bolt when said gun is shot;

an electronic circuit for controlling said pneumatic circuit, said electronic circuit including an electrical switch operated by movement of said trigger; and a gas valve mechanism mounted in said gun and adapted to be opened by engagement of the gas valve mechanism by said bolt in said front shooting position to permit passage of pressurized gas from a pressurized gas source to the barrel to propel a paintball along and out of said barrel.

2. A paintball gun according to claim 1 wherein said gas valve mechanism includes a movable operating member that normally projects into said bolt chamber and that is engaged and moved by said bolt when the bolt is moved to said front shooting position in order to open said gas valve mechanism and release said pressurized gas.

3. A paintball gun according to claim 2 wherein said movable operating member is a lever member pivotably attached to said gun body section.

4. A paintball gun according to claim 1 wherein said spring engaging member is connected to said breech section by a pin that extends through a longitudinally extending slot formed in said bolt.

5. A paintball gun according to claim 4 wherein said bolt includes a cap member secured to a rear end section of said bolt and located in said longitudinally extending passage and wherein said rear end of said spring engages said cap member.

6. A paintball gun according to claim 1 wherein said electronic circuit includes a microcomputer and means for regulating a predetermined voltage from a battery that is provided to said microcomputer.

7. A paintball gun according to claim 3 wherein said bolt has a longitudinally extending groove formed in a bottom side thereof and said lever member projects into said groove when said bolt is in the retracted position.

8. A paintball gun according to claim 1 wherein said electronic circuit includes a microcomputer, a voltage regulator to control the voltage provided to said microcomputer, a brown out circuit connected to said microcomputer, an electronic switch capable of switching said electronic circuit off under at least one preselected condition, and a manual ON/OFF switch.

9. In a gas-powered gun for firing balls, the gun having a barrel, a gun body section including a breech behind the barrel for receiving one ball at a time through a ball feed port, a trigger movably mounted in said gun body section, a bolt slidable within the breech to advance a ball to a shooting position and close off the feed port, and a regulator for supplying pressurized gas at a relatively low gas pressure, said regulator being adapted for connection to a source of relatively high pressure gas, the improvement comprising:

means for moving said bolt to a retracted position after the gun is shot;

a solenoid valve having an inlet connected to said regulator and arranged to deliver said relatively low pressure gas to a rear side of said bolt for moving said bolt forwardly to the shooting position when said solenoid valve is in an open position;

an electronic circuit for controlling said solenoid valve, said circuit including an electrical switch operated by said trigger; and valve means for permitting said relatively high pressure gas to flow into said barrel in order to propel a ball along and out of said barrel, said valve means being moved to an open position by engagement of said bolt with said valve means in said shooting position of the bolt, said valve means including a movable operating member adapted to project into a bolt chamber formed in said breech until the gun is shot, said movable operating member being moved by said bolt when said bolt is driven to said shooting position and thereby opening said valve means to release said relatively high pressure gas.

10. A gun according to claim 9 wherein said bolt moving means includes a coil spring mounted inside said bolt and engaging said bolt at one end of the spring.

11. A gun according to claim 10 wherein said bolt moving means further includes a spring engaging member mounted in a longitudinally extending passage formed in said bolt and fixedly connected to said breech, said spring engaging member holding a front end of said coil spring so as to prevent forward movement of said coil spring beyond the spring engaging member.

12. A gun according to claim 10 wherein said movable operating member is a lever member pivotably attached to said gun body section.

13. A gun operable to shoot balls, said gun comprising:

a barrel;

a gun body section attached to said barrel and including a breech section coaxial with said barrel and a movable trigger, a bolt mounted in said breech section and movable between a retracted position for ball loading and a forward position for shooting a ball;

means for moving said bolt to said retracted position after the gun is shot;

a first pneumatic circuit for delivering propellant gas from a gas supply to said barrel for propelling said ball therefrom, said first pneumatic circuit including a first gas valve mechanism, said first gas valve mechanism including a pivotable lever member adapted to project into a bolt chamber formed in said breech section until the gun is shot, said lever member being moved by said bolt when the bolt is driven to its forward position and thereby opening said first gas valve mechanism to release said propellant gas;

a second pneumatic circuit connected to receive pressurized gas from said gas supply and including a second valve for delivering pressurized gas to a rear end of said bolt for a short time interval in order to drive the bolt from said retracted position to said forward position and thereby causing said bolt to engage said first gas valve mechanism to open it and release said propellant gas to the barrel, said second pneumatic circuit including a regulator for supplying relatively low pressure gas to an inlet of said second valve which is a solenoid valve; and an electronic circuit adapted to operate said second valve, said electronic circuit being operable by said trigger.

14. A gun according to claim 13, wherein said bolt moving means includes a coil spring mounted inside said bolt and engaging said bolt at a rear end of the coil spring.

15. A gun according to claim 14, wherein said bolt moving means further includes a spring engaging member mounted in a passage formed in said bolt and fixedly connected to said breech, said spring engaging member acting as a stop that prevents forward movement of a front end of said coil spring.

* * * * *